US009947451B1

(12) United States Patent
Lighthall et al.

(10) Patent No.: US 9,947,451 B1
(45) Date of Patent: Apr. 17, 2018

(54) IGNITION COIL

(71) Applicant: Diamond Electric Mfg. Corp., Ann Arbor, MI (US)

(72) Inventors: Brian A. Lighthall, Brighton, MI (US); Sean M. Kennedy, Ypsilanti, MI (US); Paul Bryan Deignan, Lafayette, IN (US)

(73) Assignee: DIAMOND ELECTRIC MFG. CORP., Eleanor, WV (US)

( * ) Notice: Subject to any disclaimer, the term of this patent is extended or adjusted under 35 U.S.C. 154(b) by 0 days.

(21) Appl. No.: 15/464,961

(22) Filed: Mar. 21, 2017

Related U.S. Application Data

(60) Provisional application No. 62/406,536, filed on Oct. 11, 2016.

(51) Int. Cl.

| | |
|---|---|
| ***H01F 27/28*** | (2006.01) |
| ***H01F 27/02*** | (2006.01) |
| ***F02P 13/00*** | (2006.01) |
| ***F02F 1/24*** | (2006.01) |

(52) U.S. Cl.
CPC ..... *H01F 27/02* (2013.01); *F02F 1/242* (2013.01); *F02P 13/00* (2013.01); *H01F 27/28* (2013.01)

(58) Field of Classification Search
CPC ..... H01F 27/00–27/36; H01F 38/12
USPC ..... 336/90, 92, 107, 192; 123/634–365
See application file for complete search history.

(56) References Cited

U.S. PATENT DOCUMENTS

| | | | | |
|---|---|---|---|---|
| 2,506,560 | A * | 5/1950 | Tognola et al. | H01T 4/16 220/2.3 R |
| D284,001 | S | 5/1986 | Harris | |
| 4,790,767 | A | 12/1988 | Sturdevan et al. | |
| 4,859,194 | A | 8/1989 | Bartholomew | |
| 4,903,674 | A | 2/1990 | Bassett et al. | |
| 5,335,642 | A | 8/1994 | Hancock et al. | |
| 5,398,664 | A * | 3/1995 | Betz | F02P 3/02 123/635 |
| 5,444,427 | A | 8/1995 | Ida et al. | |
| 5,682,865 | A | 11/1997 | Maekawa et al. | |
| 5,706,792 | A | 1/1998 | Boyer et al. | |
| 5,870,012 | A | 2/1999 | Sakamaki et al. | |
| 6,040,659 | A | 3/2000 | Masuda et al. | |
| 6,087,918 | A | 7/2000 | Henry et al. | |

* cited by examiner

*Primary Examiner* — Tuyen Nguyen
(74) *Attorney, Agent, or Firm* — Benesch, Friedlander, Coplan & Aronoff LLP

(57) ABSTRACT

An ignition coil includes a low voltage terminal for connection with a battery and a high voltage terminal for connection with a spark plug. An assembly of windings interconnects the terminals. The ignition coil further includes a case containing the windings and the terminals. The case is configured for use with a cylinder head cover having a cylindrical bore with a key projecting radially inward of the bore. A cylindrical portion of the case has a central axis, a rotational locator surface, and an insertion guide groove configured to receive the key in the bore. A helical section of the groove is configured to receive the key when the case is in a first rotational orientation. The helical section is further configured for the rotational locator surface to move into abutment with the key upon rotation of the case from the first rotational orientation to a second rotational orientation.

20 Claims, 3 Drawing Sheets

IGNITION COIL

RELATED APPLICATIONS

This application claims priority from provisional U.S. Patent Application 62/406,536, filed Oct. 11, 2016, which is incorporated by reference.

TECHNICAL FIELD

This technology relates to an ignition coil for electrically interconnecting a vehicle battery with a spark plug in an internal combustion engine.

BACKGROUND

Ignition coils for an internal combustion engine are configured to electrically interconnect the vehicle battery with the spark plugs. Such an ignition coil may have a case containing a low voltage terminal for connection with the battery, a high voltage terminal for connection with a spark plug, and an assembly of windings interconnecting the terminals. The ignition coils are typically mounted on the engine cylinder head cover, with the case reaching through a bore in the cover.

SUMMARY

An ignition coil includes a low voltage terminal for connection with a battery and a high voltage terminal for connection with a spark plug. Windings interconnect the terminals. The ignition coil further includes a case for the windings and the terminals. The case is configured for installation on a cylinder head cover having a bore with a key projecting radially inward of the bore.

A cylindrical portion of the case has a central axis, a rotational locator surface, and an insertion guide groove configured to receive the key in the bore. A helical section of the groove receives the key when the case is in a first rotational orientation. The helical section is configured for the rotational locator surface to move into abutment with the key upon rotation of the case from the first rotational orientation to a second rotational orientation.

The case is further configured to interlock with the head cover in the second rotational orientation. In a given example, this is accomplished with at a lock section of the groove that reaches axially from the helical section. The lock section is configured to receive the key from the helical section in an interference fit upon movement of case axially when in the second rotational orientation.

In the given example, the case has three rotational locator surfaces and three corresponding grooves. Each groove is configured for the case to rotate an amount equal or substantially equal to 120 degrees from the first rotational orientation to the second rotational orientation.

DETAILED DESCRIPTION

Figure 1:
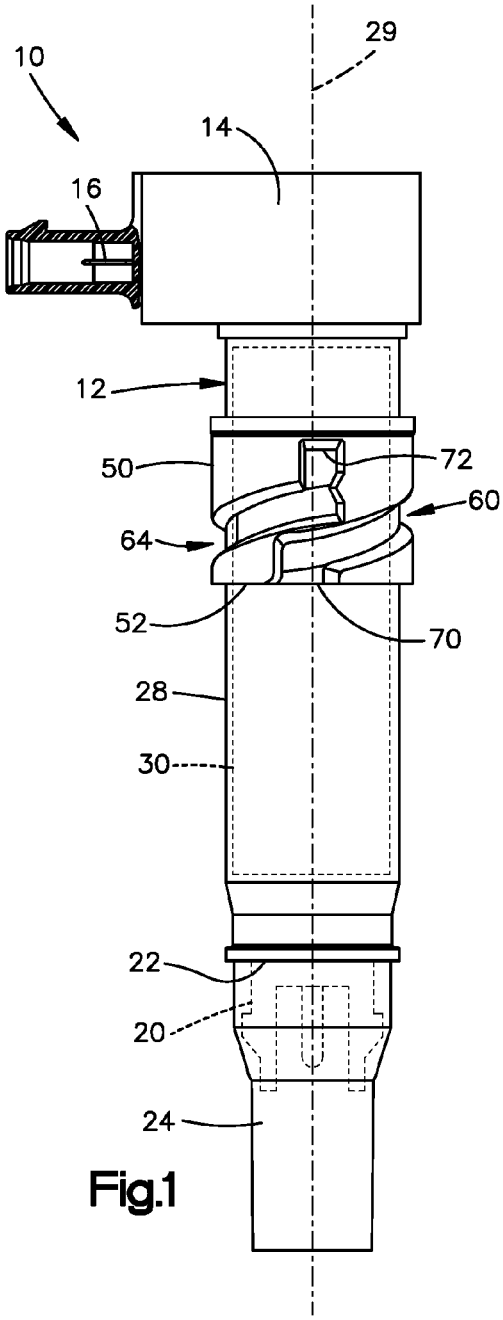
FIG. 1 is a side view of an ignition coil for an internal combustion engine.

The structures illustrated in the drawings include examples of the elements recited in the claims. The illustrated structures thus include examples of how a person of ordinary skill in the art can make and use the claimed invention. These examples are described to meet the enablement and best mode requirements of the patent statute without imposing limitations that are not recited in the claims. Elements of one embodiment may be used in combination with, or as substitutes for, elements of another as needed for any particular implementation of the invention.

Figure 2:
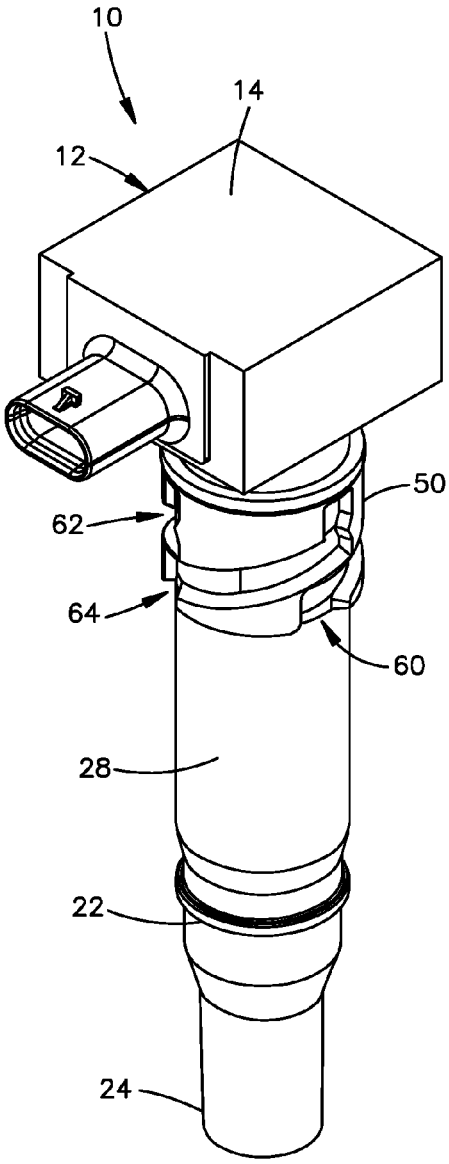
FIG. 2 is a perspective view of the ignition coil, taken from above.

As shown in FIGS. 1 and 2, an ignition coil 10 for an internal combustion engine includes a coil case 12. A upper portion 14 of the case 12 contains a low voltage terminal 16 for connection with the vehicle battery. A high voltage terminal 20 (FIG. 1) projects from a lower end 22 of the case 12 into a coupler 24 for connection with a spark plug. An elongated, cylindrical tubular portion 28 of the case 12 is centered on a longitudinal central axis 29. As shown schematically in FIG. 1, the tubular portion 28 contains an assembly 30 of primary and secondary windings for interconnecting the terminals 16 and 20.

A guide section 50 of the tubular portion 28 is diametrically enlarged, and has an annular lower end surface 52 facing axially downward. The guide section 50 is provided for guiding the coil 10 toward and into an installed position within a bore in the cylinder head cover on the engine. Specifically, the guide section 50 is configured to control the depth to which the coil 10 is inserted coaxially into the bore, and also to control the orientation of the coil 10 rotationally within the bore. This is accomplished by providing the guide section 50 with one or more insertion guide grooves for receiving keys that project radially inward from the head cover in the bore.

Figure 4:
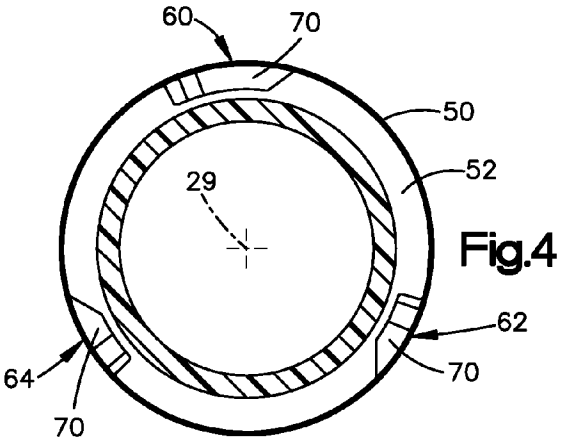
FIG. 4 is a sectional view taken on line 4-4 of FIG. 3.
Figure 5:
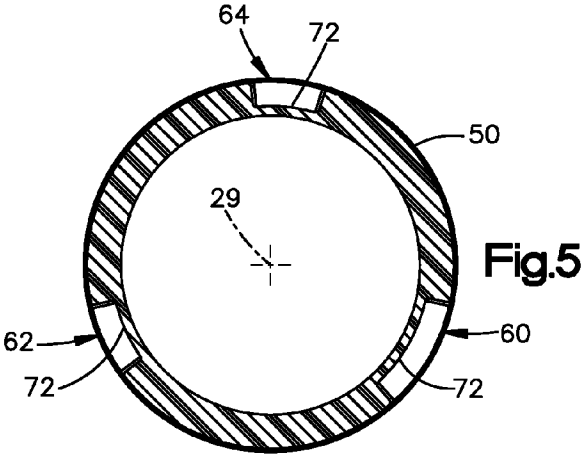
FIG. 5 is a sectional view taken on line 5-5 of FIG. 3.
Figure 3:
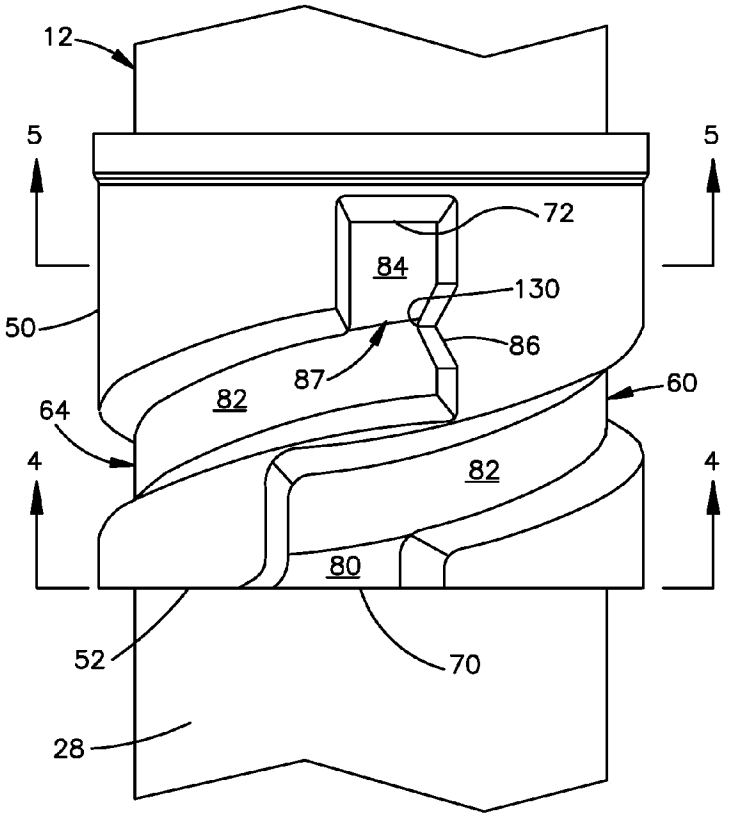
FIG. 3 is an enlarged partial view of the ignition coil.

In this example, the guide section 50 has three insertion guide grooves 60, 62 and 64. The three grooves 60, 62 and 64 are arranged about the periphery of the guide section 50 such that only the first groove 60 and the third groove 64 are shown in the side views FIGS. 1 and 3. Each groove 60, 62 and 64 has an open lower end 70 and a closed upper end 72. The grooves 60, 62 and 64 are predominantly helical such that the upper end 72 of each groove 60, 62 and 64 is spaced circumferentially from the lower end 70 an amount equal or substantially equal to 120 degrees about the axis 25. Additionally, the grooves 60, 62 and 64 are uniformly spaced apart circumferentially about the axis 29 such that the lower ends 70 are arranged as shown in FIG. 4, and the upper ends 74 are arranged as shown in FIG. 5.

Each of the three grooves 60, 62 and 64 has an entry section 80, a helical section 82, and a lock section 84. The entry section 80 is axially linear, and reaches upward from the lower end 70. The helical section 82 reaches circumferentially and axially from the entry section 80 to a rotational locator surface 86. The lock section 84 reaches axially upward from the helical section 82, and has an opening 87 defined in part by the rotational locator surface 86. Accordingly, the grooves 60, 62 and 64 are alike, with the exception that the first groove 60 is wider that the other two grooves 62 and 64.

Figure 6:
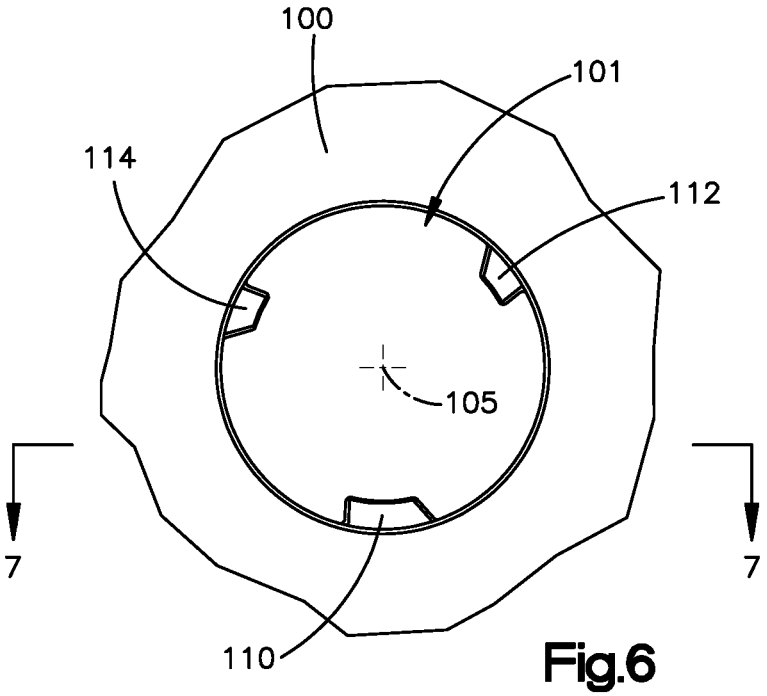
FIG. 6 is partial view of a cylinder head cover for an internal combustion engine.
Figure 7:
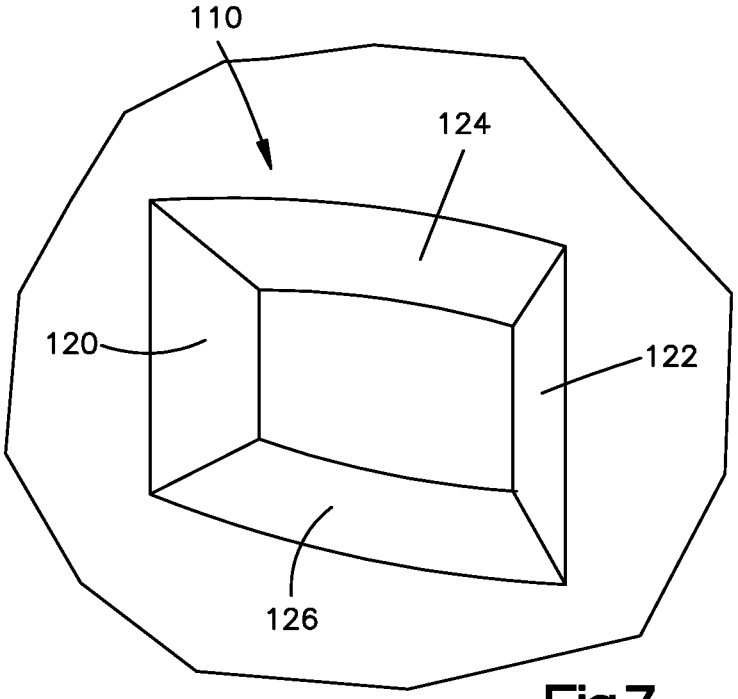
FIG. 7 is a sectional view taken on line 7-7 of FIG. 6.

As shown partially in FIGS. 6 and 7, a cylinder head cover 100 for an internal combustion engine has a cylindrical bore 101 with a longitudinal central axis 105. The head cover 100 is configured to receive and support the case 12 coaxially within the bore 101, and thereby to support the coil 10 in operative relationship with a spark plug.

The inner diameter of the bore 101 is sized for guide section 50 of the case 12 to fit closely within the bore 101. The head cover 100 further has an array of keys corresponding to the array of insertion guide grooves on the case 12. The head cover 100 in the illustrated example thus has three keys 110, 112 and 114 projecting radially inward of the bore 101. The keys 110, 112 and 114 are located uniformly along the axis 105, and are uniformly spaced apart circumferentially about the axis 105.

Each of the three keys 110, 112 and 114 has the configuration shown in FIG. 7, although the first key 110 is larger than the second and third keys 112 and 114 to accommodate the size of the first groove 60. Each key 110, 112 and 114 thus has a rotational leading end surface 120, a rotational trailing end surface 122, and axially opposite side surfaces 124 and 126. The side surfaces 124 and 126 are inclined at the slope of the helical groove sections 82 on the case 12.

The coil 10 is installed in the head cover 100 by moving the tubular portion 28 of the case 12 coaxially inward of the bore 101 until the lower end 52 of the guide section 50 moves into abutment with the keys 110, 112 and 114. The case 12 is then rotated about the axis 29 to a first rotational orientation in which the wider groove 60 is aligned with the wider key 110. The keys 110, 112 and 114 are received axially through the open lower ends 70 of the grooves 60, 62 and 64, and are advanced through the entry sections 80 into the helical sections 82, upon further movement of the case 12 axially downward in the first rotational orientation. The open lower ends 70 are preferably wider than the entry sections 80 to facilitate entry of the keys 110, 112 and 114. Importantly, the low voltage terminal 16 has a first predetermined alignment to the head cover 100 when the case 12 is in the first rotational orientation.

The case 12 is next rotated about the axis 29 so that the helical sections 82 of the grooves 60, 62 and 64 move across the keys 110, 112 and 114. This draws the case 12 further downward along the axis 105 as the keys 110, 112 and 114 are advanced relatively upward along helical sections 82 toward the rotational locator surfaces 86. The case 12 reaches a second rotational orientation when the rotational locator surfaces 86 move onto abutment with the keys 110, 112 and 114 at the leading end surfaces 120. When the case 12 is in the second rotational orientation, the low voltage terminal 16 has a second predetermined alignment with the head cover 100 as needed for connection with a battery cable connector.

With the case 12 in the second rotational orientation, the coil 10 is pressed into an installed position by pushing the case 12 still further downward along the axis 105. This drives the keys 110, 112 and 114 relatively upward to positions projecting through the openings 87 into the lock sections 84 of the grooves 60, 62 and 64. The openings 87 are sized for each key 110, 112 and 114 to establish an interference fit with the case 12 at the respective opening 87. In the illustrated example, each rotational locator surface 86 has a contour configured with an apex 130 to provide point contact for establishing the interference fit with the respective key 110, 112 or 114. As a result, the case 12 is securely but releasably interlocked with the head cover 100 in the second rotational orientation.

This written description sets forth the best mode of carrying out the invention, and describes the invention so as to enable a person skilled in the art to make and use the invention, by presenting examples of the elements recited in the claims. The patentable scope of the invention is defined by the claims, and may include other examples that do not differ from the literal language of the claims, as well as equivalent examples with insubstantial differences from the literal language of the claims.

What is claimed is:

1. An apparatus for use with a spark plug, a battery, and a cylinder head cover having a cylindrical bore with a key projecting radially inward of the bore, the apparatus comprising:

an ignition coil having a low voltage terminal configured for connection with the battery, a high voltage terminal configured for connection with the spark plug, windings interconnecting the terminals, and a case for the windings and the terminals;

wherein the case has a cylindrical portion with a central axis, a rotational locator surface, and an insertion guide groove configured to receive the key in the bore;

wherein the groove has a helical section configured to receive the key when the case is in a first rotational orientation, and the helical section is further configured for the rotational locator surface to move into abutment with the key upon rotation of the case from the first rotational orientation to a second rotational orientation.

2. An apparatus as defined in claim 1 wherein the case is configured to interlock with the head cover in the second rotational orientation.

3. An apparatus as defined in claim 2 wherein the groove further has a lock section reaching axially from the helical section, and the lock section is configured to receive the key from the helical section in an interference fit upon movement of case axially when in the second rotational orientation.

4. An apparatus as defined in claim 1 wherein the low voltage terminal has a predetermined alignment with the head cover when the case is in the second rotational orientation.

5. An apparatus as defined in claim 1 wherein the groove is configured for the case to rotate an amount equal or substantially equal to 120 degrees from the first rotational orientation to the second rotational orientation.

6. An apparatus as defined in claim 5 wherein the case has multiple rotational locator surfaces, and the groove is one of multiple insertion guide grooves, each of which corresponds to a respective rotational locator surface and is configured for the case to rotate an amount equal or substantially equal to 120 degrees from the first rotational orientation to the second rotational orientation.

7. An apparatus as defined in claim 6 wherein the grooves are uniformly spaced apart circumferentially about the axis.

8. An apparatus as defined in claim 6 wherein the grooves consist of three grooves.

9. An apparatus as defined in claim 6 wherein the grooves include multiple grooves having a common width and a single groove having a greater width.

10. An apparatus as defined in claim 1 wherein the groove has an open end configured to receive the key upon movement of the case axially when in the first rotational orientation, the groove further has a linear entry section reaching axially from the open end to the helical section, and the helical section reaches circumferentially and axially from the entry section to the rotational locator surface.

11. An apparatus for use with a spark plug and a battery, the apparatus comprising:

a cylinder head cover having a cylindrical bore with a key projecting radially inward of the bore; and an ignition coil having a low voltage terminal configured for connection with the battery, a high voltage terminal configured for connection with the spark plug, windings interconnecting the terminals, and a case for the windings and the terminals;

wherein the case has a cylindrical portion with a central axis, a rotational locator surface, and an insertion guide groove configured to receive the key in the bore;

wherein the groove has a helical section configured to receive the key when the case is in a first rotational orientation, and the helical section is further configured for the rotational locator surface to move into abutment with the key upon rotation of the case from the first rotational orientation to a second rotational orientation; and wherein the case and the head cover are together configured for case to interlock with the head cover in the second rotational orientation.

12. An apparatus as defined in claim 11 wherein the low voltage terminal has a predetermined alignment with the head cover when the case is in the second rotational orientation.

13. An apparatus as defined in claim 11 wherein the groove further has a lock section reaching axially from the helical section, and the lock section is configured to receive the key from the helical section in an interference fit upon movement of case axially when in the second rotational orientation.

14. An apparatus as defined in claim 11 wherein the groove is configured for the case to rotate an amount equal or substantially equal to 120 degrees from the first rotational orientation to the second rotational orientation.

15. An apparatus as defined in claim 14 wherein the head cover has multiple keys projecting radially inward of the bore, the case has multiple rotational locator surfaces corresponding to the multiple keys, and the groove is one of multiple grooves, each of which has a helical section corresponding to a respective rotational locator surface, and each helical section is configured for the case to rotate an amount equal or substantially equal to 120 degrees from the first rotational orientation to the second rotational orientation.

16. An apparatus as defined in claim 15 wherein the grooves are uniformly spaced apart circumferentially about the axis.

17. An apparatus as defined in claim 15 wherein the grooves consist of three grooves.

18. An apparatus as defined in claim 15 wherein the grooves include multiple grooves having a common width and a single groove having a greater width.

19. An apparatus as defined in claim 11 wherein the groove has an open end configured to receive the key upon movement of the case axially when in the first rotational orientation, the groove further has a linear entry section reaching axially from the open end to the helical section, and the helical section reaches circumferentially and axially from the linear entry section to the rotational locator surface.

20. An apparatus as defined in claim 19 wherein the open end of the groove is circumferentially wider than the entry section.

* * * * *